United States Patent [19]

Beaver, Jr.

[11] 4,055,924

[45] Nov. 1, 1977

[54] INEXPENSIVE AND DISASSEMBLABLE STRUCTURAL UNITS

[76] Inventor: Emil R. Beaver, Jr., 4148 S. Crane Road, Tipp City, Ohio 45371

[21] Appl. No.: 665,712

[22] Filed: Mar. 10, 1976

[51] Int. Cl.[2] ..... E04B 1/00

[52] U.S. Cl. ..... 52/262; 52/264; 46/21; 46/30; 297/442; 312/107; 312/257 R

[58] Field of Search ..... 46/30, 21, 25; 312/111, 312/107, 257; 297/442; 52/262, 264, 236, 286

[56] References Cited

U.S. PATENT DOCUMENTS

| | | | |
|---|---|---|---|
| 1,894,061 | 1/1933 | Sanders | 46/25 |
| 2,558,591 | 6/1951 | Starck | 46/30 |
| 2,825,101 | 3/1958 | Rubenstein | 297/447 |
| 3,570,418 | 3/1971 | Gooding | 297/440 |
| 3,644,008 | 2/1972 | Overby | 312/107 |
| 3,788,700 | 1/1974 | Wartes | 297/442 |
| 3,820,294 | 6/1974 | Parker | 52/262 |
| 3,924,376 | 12/1975 | Tsarumi | 46/25 |

FOREIGN PATENT DOCUMENTS

| | | | |
|---|---|---|---|
| 640,199 | 7/1950 | United Kingdom | 46/21 |
| 443,055 | 2/1936 | United Kingdom | 46/21 |
| 491,750 | 9/1938 | United Kingdom | 46/25 |
| 1,207,290 | 9/1970 | United Kingdom | 46/25 |
| 1,491,466 | 7/1967 | United Kingdom | 46/25 |

*Primary Examiner*—Price C. Faw, Jr.
*Assistant Examiner*—Henry Raduazo

[57] ABSTRACT

A method of construction for inexpensive and readily disassemblable structural units by the means of locating slots and tabs as engineered systems in sheet materials to produce forces of containment and opposition without permanent joining.

3 Claims, 5 Drawing Figures

INEXPENSIVE AND DISASSEMBLABLE STRUCTURAL UNITS

SUMMARY OF THE INVENTION

Devices commonly known as slot and tab or mortice and tenion or by other equivalent names are utilized in a novel system to produce opposing and interlocking force vectors which result in three-dimensional rigidity without usage of any permanent jointures, thereby being of useful service to a mobile society of disassembling easily to a least-volume solid package.

DESCRIPTION OF THE INVENTION

Figure 1:
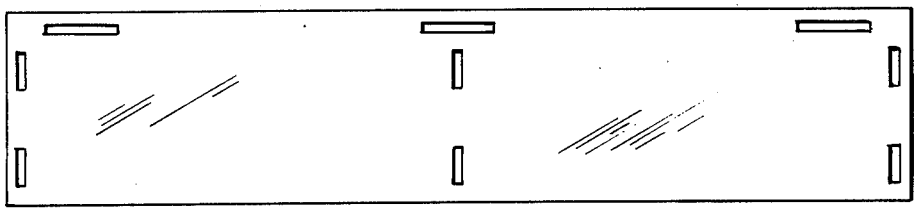
FIG. 1 is a plan view of horizontal panels utilized in the present invention.

The teachings of this invention permit the erection of strong structural units that are rigid in all dimensions, without usage of any permanent joining, for a variety of applications. The avoidance of permanent joints permits easy reduction of the unit to a least volume solid package when the purpose of the unit has been completed or the unit is to be moved to a new location. The design system is believed to differ substantially from earlier, cosmetically similar, usage of the slot-tab devices in such widely varying applications as barns and paper dolls. The system requires use of sheet materials having multi-directional strengths, such as plywood, fiberboard and hardboard, to resist the multi-directional forces imposed. The location of the temporary slot-tab joints in the system is critical to the uniform distribution of loading forces, whereupon the unit strength approximates the strength of the material used. Tensile and shear stresses are involved in local areas, but the system design goal is to translate these stresses into predominately compressive functions.

System usage is visualized over a range from modular buildings to small boxes, but primary usage is expected to occur in nonmotive furniture cabinetry such as storage shelving, bookcases, tables, doll houses and cabinets. A bookcase is shown in the drawings as a typical unit example. It is noted that system rigidity increases directly with load increases, due to the stress distribution design, within the strength of material.

Figure 2:
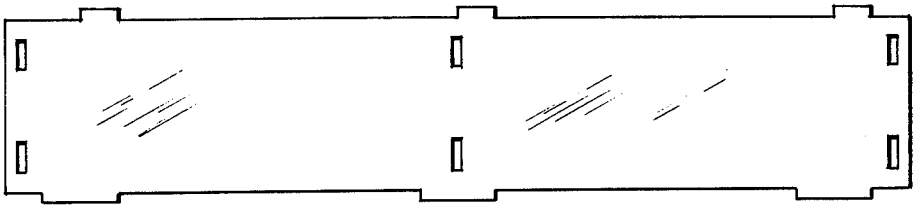
FIG. 2 is a plan view of longitudinal vertical panels adapted to engage two of the horizontal panels of FIG. 1 for the uppermost and lowermost tiers of the present invention.
Figure 3:
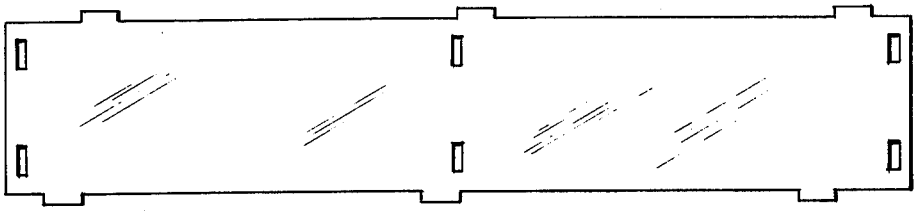
FIG. 3 is a plan view of longitudinal vertical panels adapted to engage two of the horizontal panels of FIG. 1 for the intermediate tiers of the present invention.
Figure 4:
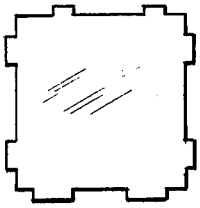
FIG. 4 is a plan view of transverse vertical panels adapted to engage the panels of FIGS. 1 and 2 in the present invention.
Figure 5:
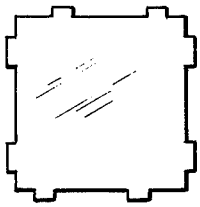
FIG. 5 is a plan view of transverse vertical panels adapted to engage the panels of FIGS. 1 and 3 in the present invention.

Drawing FIG. 1 represents the parts pattern for the components lying in a horizontal plane or the shelves of the bookcase. The number of parts required is the number of shelf spaces desired plus one. FIG. 2 represents the vertical back of the top and bottom shelf spaces, having total tabs on one long edge and half-tabs on the other to interlock with a matching structure within the appropriate slots of FIG. 1. The number of parts required is two. FIG. 3 represents the vertical backs of the intermediate shelf spaces, having interlocking half-tabs on both long edges and requiring number of parts equal to the number of shelf spaces less two. FIG. 4 represents the vertical shelf ends and middle supports for the top and bottom shelf spaces with tabs analogous to those of FIG. 2 and requiring six parts. FIG. 5 represents the vertical shelf ends and middle supports for the intermediate shelf spaces, has the interlocking half-tabs on both top and bottom edges analogous to FIG. 3 and requires a number of parts equal to the number of shelf spaces times three and less six.

In the assembly sequence, one part from the pattern of FIG. 1 is placed on the floor. The side tabs of three parts from FIG. 4 are inserted into the matching slots of one part from FIG. 2 with the full-tabs down and these full-tabs inserted into the slots of the first part placed on the floor. A second part from the pattern of FIG. 1 is then placed over the upper exposed half-tabs of the assembled parts. The process is repeated for the intermediate shelves using parts from FIGS. 3 and 5 in the same manner and with half-tabs interlocking in the slots. The case is completed by finishing with the remaining set of parts from FIGS. 2 and 4 with the full-tabs up and the remaining part from FIG. 1 placed over them to form the top and lock the assembly into a three-dimensionally rigid unit ready for use. The reverse procedure disassembles the case, resulting in a solid stack of material approximating the total volume of the component parts for storage or moving.

System design criteria requires, firstly, that the edge slots be placed a distance from the edge normally equal to the thickness dimension of the material. Interior slots are, secondly, normally so placed as to divide the remaining space in the number of segments required by a calculation of the strength of the material and the design load. The tab insertion length is, thirdly, normally equal to the material thickness dimension to accomplish the criterion of containment. The tab width is, fourthly, a maximum function of four times the material thickness dimension. The tab width is, fifthly, a minimum function of twice the material thickness dimension. The tab-slot spacing is, sixthly, a minimum of two per linear edge of tab or slot device to derive alignment and of a number two or greater calculated from the strength of material and design load in vectors of containment and support. The satisfaction of said system design criteria comprises and describes the subject invention system.

I claim:

1. A class of non-permanent structures characterized by locking and interlocking panels of uniform thickness which may be assembled in a variety of modes to provide a plurality of different structures, said panels including:

a. a first plurality of rectangular panels, each such first panel having:

1. a first plurality of slots of a first predetermined length, said first slots extending longitudinally along a first long edge of said first panel in a uniformly spaced array, with each of said first slots having a width equal to said uniform thickness; and
2. a second plurality of slots of a second predetermined length, said second slots extending perpendicularly to said first long edge of said first panel and being spaced at intervals along said first long edge thereof, said second slots also having a width equal to said uniform thickness; and b. a second plurality of longitudinal vertical panels, each such panel having:

1. a first plurality of tabs of said first predetermined length, said first tabs extending along a first long edge of said second panel in a uniformly spaced array corresponding to the spaced array of said first slots of said first panel so as to be engageable therewith;
2. a second plurality of tabs of one-half said first predetermined length, said second tabs extending along a second long edge of said second panel in a uniformly spaced array and positioned thereon so as to be engageable, in a first relative orientation of said first and second panels, and engageable in a second relative orientation of said first and second panels, within the other half of the first slots of said first panels; and
3. a third plurality of slots of said second predetermined length, said third slots extending perpendicularly to the long edges of said second panel and being spaced therealong in manner identical to the spacing of said second slots of said first panel; and c. a third plurality of transverse vertical panels, each such third panel having:

1. a third plurality of tabs of said second predetermined length positioned along a first edge of said third panel, said third tabs being engageable with second slots of said first panel;
2. a fourth plurality of tabs, each comprising one-half of said third tab and half of said second predetermined length, positioned along a second edge of said third panel, said second edge of said third panel being disposed on opposite side of said third panel from first edge, said half tabs positioned thereon so as to be engageable with the fourth half-tabs of another said third panel within the second slots of said first panel; and
3. a fifth plurality of tabs of said second predetermined length positioned along a third edge of said third panel and intermediate to said first and second edges thereof, so as to be engageable with said third slots of said second panel when said first, second, and third panels are joined at right angles to each other.

2. A non-permanent structure as claimed in claim 1 further including a fourth plurality of horizontal vertical panels, each such fourth panel substituting for said second panels in intermediate locations and having:

1. a sixth plurality of tabs of one-half said first predetermined length, said sixth half-tabs extending along a first long edge of said fourth panel in a uniformly spaced array corresponding with said first slots of said first panels and engageable with the half-tabs of another horizontal vertical panel within said first slots of said first panel;
2. a seventh plurality of tabs of one-half said first predetermined length, said seventh half-tabs extending along a second long edge of said fourth panel in a uniformly spaced array corresponding with said first slots of said first panel and engageable with the half-tabs of another horizontal vertical panel within said first slots of said first panel; and
3. a fourth plurality of slots of second predetermined length, said fourth slots extending perpendicularly to the long edges of said fourth panel and being spaced at intervals therealong in manner identical to the spacing of said second slots of said first panel.

3. A non-permanent structure as claimed in claim 1 further including a fifth plurality of transverse vertical panels, each such fifth panel substituting for said third panel in intermediate locations and having:

1. an eighth plurality of tabs, each comprising one-half of said second predetermined length, positioned along a first edge of said fifth panel, said eighth half-tabs positioned thereon so as to be engageable with the half-tabs of another transverse vertical panel within said second slots of said first panel;
2. a ninth plurality of tabs, each comprising one-half of said second predetermined length, positioned along a second edge of said fifth panel, said second edge of said fifth panel being disposed on opposite side of said fifth panel from first edge, said ninth half-tabs positioned thereupon so as to be engageable with the half-tabs of another transverse vertical panel within said second slots of said first panel; and
3. a tenth plurality of tabs of said second predetermined length, positioned along a third edge of said fifth panel and intermediate to said first and second edges thereof, so as to be engageable with said fourth plurality of slots of said fourth panel when said first, fourth and fifth panels are joined at right angles to each other.

* * * * *